US006336712B1

(12) United States Patent
Kagayama

(10) Patent No.: US 6,336,712 B1
(45) Date of Patent: Jan. 8, 2002

(54) IMAGE FORMATION APPARATUS HAVING A TONER FLOW CONTROL MEMBER WITH A PROTECTION LAYER

(75) Inventor: Shigeru Kagayama, Owariasahi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 08/207,142

(22) Filed: Mar. 8, 1994

(30) Foreign Application Priority Data

May 14, 1993 (JP) ..... 5-113222

(51) Int. Cl.[7] ..... B41J 2/06
(52) U.S. Cl. ..... 347/55
(58) Field of Search ..... 347/55, 111, 112, 347/120, 127, 141; 355/261, 262, 264, 284; 118/652

(56) References Cited

U.S. PATENT DOCUMENTS 3,689,935 A 9/1972 Pressman et al. ..... 347/55
4,743,926 A * 5/1988 Schmidlin et al. ..... 347/55
5,036,341 A 7/1991 Larsson ..... 347/55
5,153,611 A * 10/1992 Kokado et al. ..... 347/55
5,404,155 A * 4/1995 Kitmura ..... 347/55 X

FOREIGN PATENT DOCUMENTS

JP 63-145052 * 6/1988 ..... 347/203
JP 3-254949 * 11/1991 ..... 347/55
JP 4-142952 * 5/1992 ..... 347/55
JP 4-144757 * 5/1992 ..... 347/55

* cited by examiner

*Primary Examiner*—Benjamin R. Fuller
*Assistant Examiner*—C Dickens
(74) *Attorney, Agent, or Firm*—Oliff & Berridge, PLC

(57) ABSTRACT

An image forming apparatus uses an electrode member with apertures therein through which toner is passed according to image data to form an image on a supporter. The electrode member has an insulative inorganic substance formed thereon to protect a surface of the electrode member from wear. Thus, the supply of toner through the apertures in the electrode is stable. Further, since the protection layer of inorganic substance is arranged on the toner carrying roller side of the aperture electrode member, the image forming apparatus has an excellent image forming property.

22 Claims, 3 Drawing Sheets

IMAGE FORMATION APPARATUS HAVING A TONER FLOW CONTROL MEMBER WITH A PROTECTION LAYER

BACKGROUND OF THE INVENTION

1. Field of the Invention

The present invention relates to an image forming apparatus such as a copier, a printer, a plotter or a facsimile machine.

2. Description of Related Art

One type of image forming apparatus that has been conventionally proposed is an image forming apparatus using an electrode having plural opening portions (hereinafter referred to as "apertures") disclosed in U.S. Pat. No. 3,689,935. In this image forming apparatus, a voltage is applied to the electrode while being modulated in accordance with image data to thereby control the passage of toner through the apertures and form an image on a supporter with the passed toner.

This image forming apparatus includes an insulating flat plate, a continuous reference electrode formed on one surface of the flat plate, and plural control electrodes formed on the other surface of the flat plate and electrically insulated from one another. The apparatus further includes an aperture electrode member having at least one array of apertures, each of which is provided in correspondence with each control electrode so as to penetrate through the flat plate, the reference electrode and the control electrode. Also provided are means for selectively applying potential between the reference electrode and each of the control electrodes, means of supplying charged toner to modulate the flow of toner that has been just passed through the apertures in accordance with the supplied potential and means for positioning the supporter in a toner-particle flowing passage such that the supporter and the aperture electrode member are movable relatively to each other.

However, in the above-mentioned image forming apparatus, because an electric field in the apertures is used to control the flow of the charged toner particles, an electric field outside the apertures is weakened significantly. Therefore, the amount of the toner particles passing through the apertures in a predetermined time is slow. Thus, the image forming speed is slow, since the electric force for drawing toner particles supplied under the apertures into the apertures is weak.

SUMMARY OF THE INVENTION

An object of the present invention is to provide an image forming apparatus having a stable and excellent image forming property.

To improve the strength of the electric force drawing toner particles through apertures in an aperture electrode member, the toner particle carrying roller is arranged to contact the aperture electrode member. By this arrangement, an image is formed by controlling the toner particle flow with a strong electric field formed between the control electrode of the contacting aperture electrode member and a toner particle carrying roller.

The aperture electrode member is preferably formed with an insulative sheet such as a polyimide film. However, such an insulative sheet will become charged and worn off due to its sliding operation with the toner carrying roller. Further, toner particles will become fixed on the insulative sheet, and, therefore, a proper control electric field cannot be formed between the control electrodes and the toner carrying roller since the insulative sheet is charged by the sliding operation with a toner particle layer formed on the toner carrying roller. Moreover, the life of the insulative sheet will be shortened since the insulative sheet will wear off due to the sliding operation and toner particles that become fixed on the insulative sheet. Therefore, to prevent these problems, an insulative inorganic substance is provided on at least a surface of the insulative sheet facing the carrying roller.

To achieve the above and other objects, the image forming apparatus of the present invention comprises a supporting member for supporting and supplying charged toner particles, and toner flow control means having openings and control electrodes around the openings. The toner flow control means sandwiches the charged particles with the supporting member and controls a flow of the charged particles through the openings by an electric field. A back electrode is provided that confronts the toner flow control means sandwiching an image receiving medium therebetween. Additionally, an insulative inorganic substance is provided on at least a surface of the toner flow control means facing the supporting member.

In the image forming apparatus of the above-described structure, the electrodes themselves are not charged and not worn off because the insulative inorganic substance is provided on the electric field control means. Therefore, toner particles are always supplied stably, and an unnecessary electric field is not formed when toner particles are transferred. As a result, the image forming apparatus has an excellent image forming property and excellent product stability.

BRIEF DESCRIPTION OF THE DRAWINGS

Preferred embodiments of the present invention are described in detail referring to the following figures wherein.

DETAILED DESCRIPTION OF PREFERRED EMBODIMENTS

Figure 1:
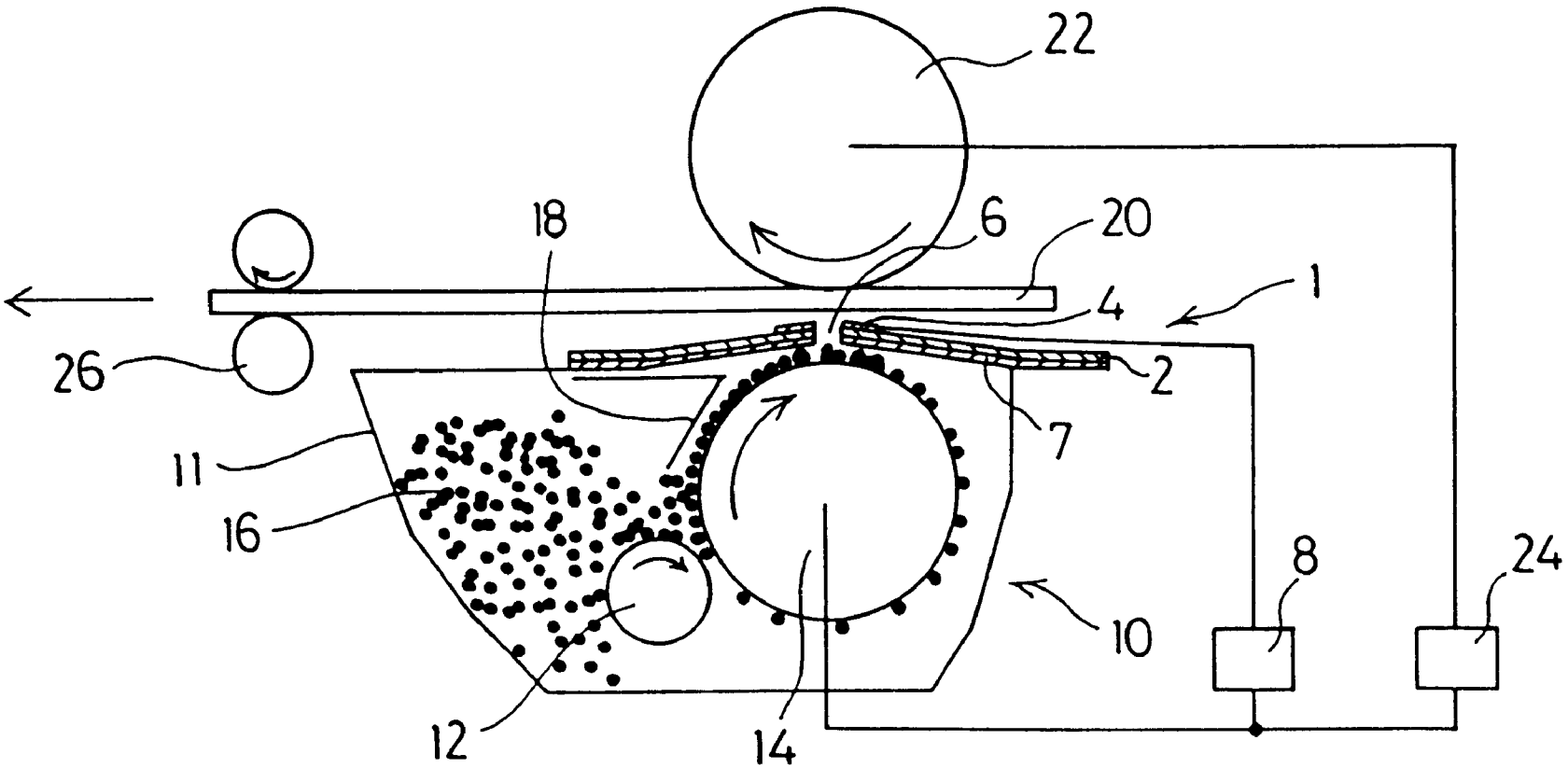
FIG. 1 is a schematic side view in partial section of the image forming apparatus of the preferred embodiment.

Hereafter, preferred embodiments that illustrate the present invention are explained referring to the drawings.

FIG. 1 shows an image forming apparatus according to the preferred embodiment. A back electrode roller 22 of a column shape is arranged pivotally on a chassis (not shown) having approximately a one millimeter space between the back electrode roller 22 and an upper surface of the aperture electrode member 1. The aperture electrode member 1 comprises an insulative sheet 2, preferably a polyimide film. An image supporting medium 20 is inserted in the space and transported. A toner particle supply device 10 is arranged under the aperture electrode member 1 along the longitudinal direction of the aperture electrode member 1. In addition, a fixing device 26 is arranged in the transporting path of the image supporting medium 20, which is transferred by the back electrode roller 22.

The toner particle supply device 10 comprises a toner particle casing 11, which is a housing of the apparatus, toner particles 16 stored in the toner particle casing 11, a supplying roller 12, a toner particle carrying roller 14, which is a supporting medium, and a toner particle layer trimming blade 18. The toner particle carrying roller 14 supports toner particles 16 and transfers the toner particles 16 toward the aperture electrode member 1. The supplying roller 12 supplies toner particles 16 to the toner particle carrying roller 14. The supplying roller 12 and the toner particle carrying roller 14 are supported by the toner particle casing 11. The rollers 12 and 14 are rotatable in the direction of the arrows shown in FIG. 1. The rollers 12 and 14 are arranged in parallel and contact each other.

The toner particle layer trimming blade 18 contacts the toner particle carrying roller 14 under pressure. The toner particle layer trimming blade 18 adjusts the amount of toner particles 16 carried on the toner particle carrying roller 14 so that the amount of toner particles 16 is kept uniform on the roller 14 and the blade 18 charges the toner particles 16 uniformly.

Figure 2:
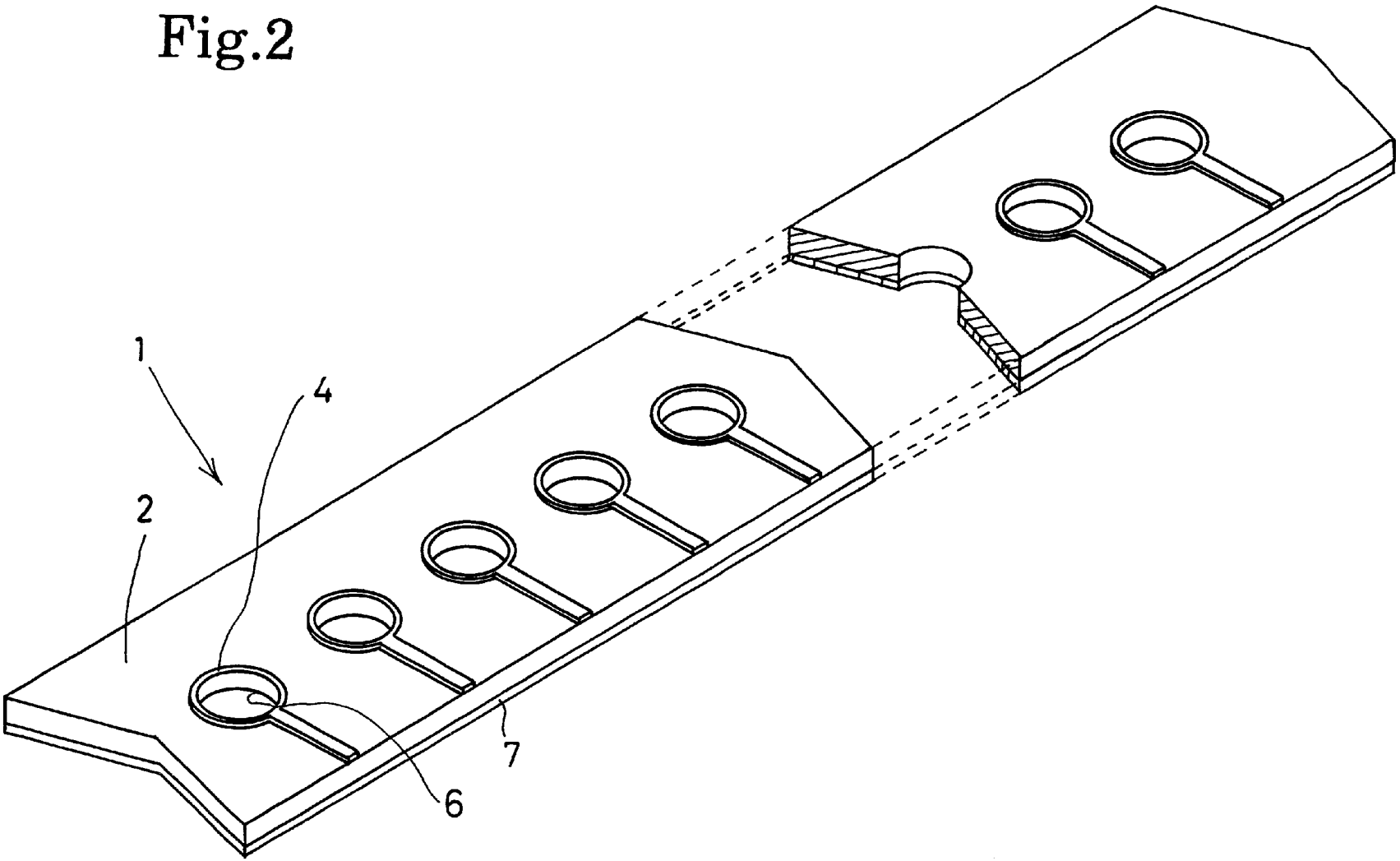
FIG. 2 is a perspective view in partial section showing the construction of the aperture electrode member of the preferred embodiment.

A row of apertures 6 is formed in the polyimide insulative sheet 2 of the aperture electrode member 1, as shown in FIG. 2. The diameter of each aperture 6 is preferably approximately 100 $\mu$m, and the insulative sheet preferably has a thickness of approximately 25 $\mu$m. Control electrodes 4 of preferably approximately 1 $\mu$m thickness are formed around the apertures 6 on the insulative sheet 2. The aperture electrode member 1 is arranged so that the control electrodes 4 face the image supporting medium 20 and the insulative sheet 2 contacts toner particles 16 carried on the toner particle carrying roller 14 in its aperture position, as shown in FIG. 3.

Figure 3:
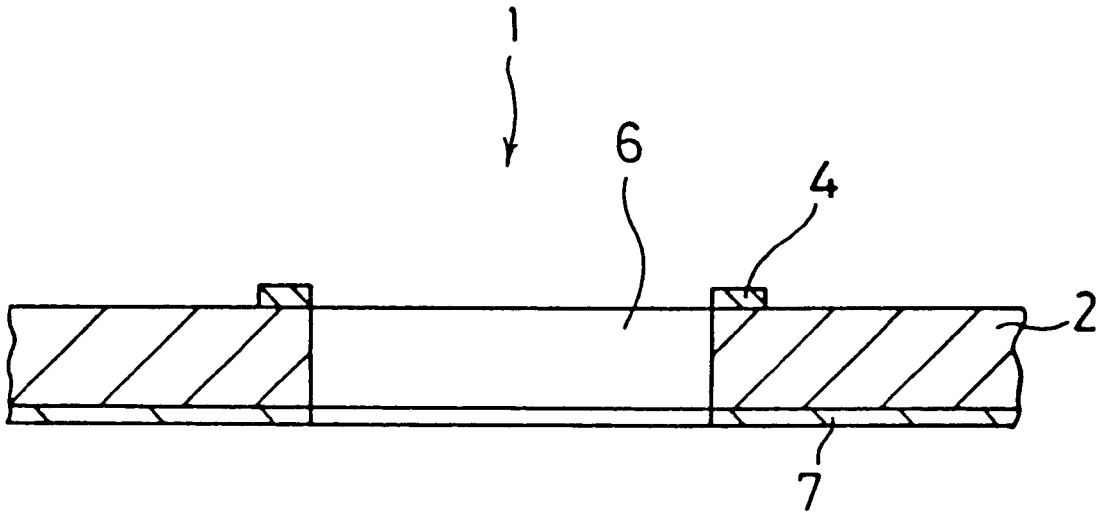
FIG. 3 is a partial cross-sectional view of the aperture electrode member of the preferred embodiment.

The modulating electrode member 1 of this embodiment is further explained referring to FIG. 3.

FIG. 3 is a cross-sectional view of the aperture electrode member 1. The protection layer 7 is covered over the carrying roller side of the aperture electrode member 1. Preferably, the protection layer 7 is an inorganic substance, which does not have a charging property. For example, alumina, zirconia, nitriding silicon, carbonization silicon, oxidation silicon, oxidation chrome, oxidation tantalum, nitriding tantalum, titanium oxide and glass can be used as the inorganic substance. The protection layer 7 can be formed by a thin film formation method such as sputtering, evaporation and CVD, the sol-gel method, or the screen print method.

A control voltage applying circuit 8 is connected between the control electrodes 4 and the toner particle carrying roller 14. The control voltage applying circuit 8 applies a voltage of 0 volt or +50 volts to the control electrodes 4 based on the image signal. Moreover, a DC power supply 24 is connected between the back electrode roller 22 and the toner particle carrying roller 14. The DC power supply 24 applies a voltage of +1kV to the back electrode roller 22.

In operation, the toner particles 16 are sent from the supplying roller 12 by rotation of the toner particle carrying roller 14 and the supplying roller 12 in the direction of the arrow shown in FIG. 1. When the toner particles 16 are rubbed with the toner particle carrying roller 14, the toner particles 16 are negatively charged and are supported on the toner particle carrying roller 14. After the supported toner particles 16 are formed as a thin layer by the layer trimming blade 18 and charged, the charged toner particles 16 are transferred toward the aperture electrode member 1 by the rotation of the toner particle carrying roller 14. The toner particles 16 supported on the toner particle carrying roller 14 are supplied under the apertures 6.

The image forming apparatus of this embodiment does not experience problems caused from the charge of the insulative sheet 2 or the fixing of toner particles on the insulative sheet 2 since the protection layer 7 is formed on the insulative sheet 2. That is, since the protection layer 7 is formed with an insulative inorganic substance, the protection layer 7 is not charged and few toner particles are fixed on the layer 7, even if the layer 7 slides with the toner particles 16 or the carrying roller 14. Therefore, toner particles are supplied quite properly, and the apparatus has an excellent image forming property in this embodiment. This is in sharp distinction from the prior art in which the toner layer is disordered due to the charge of the insulative layer or the fixing of toner particles on the insulative layer in the conventional apparatus.

The voltage of +50 volts is applied from the control voltage applying circuit 8 to the control electrodes 4, which correspond to the image portion according to the image signal. As a result, an electric force line forwarding to the toner particle carrying roller 14 from the control electrodes 4 is formed adjacent to the apertures 6 corresponding to the image portion by the potential difference between the control electrodes 4 and the toner particle carrying roller 14. Accordingly, since the negatively charged toner particles receive an electrostatic force toward the direction of a higher potential, the negatively charged toner particles pass through the apertures 6 from the toner particle carrying roller 14 to the control electrode 4 side. The toner particles 16 drawn out to the control electrode 4 side are attracted toward the image supporting medium 20 by the electric field formed between the image supporting medium 20 and the aperture electrode member 1 by the voltage applied to the back electrode 22. The toner particles 16 accumulate on the image supporting medium 20 to form a pixel.

The voltage of 0 volt is applied to the control electrodes 4 that correspond to the non-image portion from the control voltage applying circuit 8. As a result, the toner particles 16 supported on the toner particle carrying roller 14 do not pass through the apertures 6 since the electric field is not formed between the toner particle carrying roller 14 and the control electrodes 4. Thus, the toner particles 16 on the roller 14 do not have an electrostatic force.

While a row of pixels are formed on the image supporting medium 20 with toner particles 16, the image supporting medium 20 is fed one pixel at a time in the direction perpendicular to the row of apertures. The toner particle image is formed over the image supporting medium 20 by repeating the above-mentioned process. Afterwards, the formed toner particle image is fixed on the image supporting medium 20 by the fixing device 26.

It is to be understood that the present invention is not restricted to the particular forms shown in the foregoing embodiment. Various modifications and alterations can be made thereto without departing from the scope of the invention encompassed by the appended claims.

Figure 4:
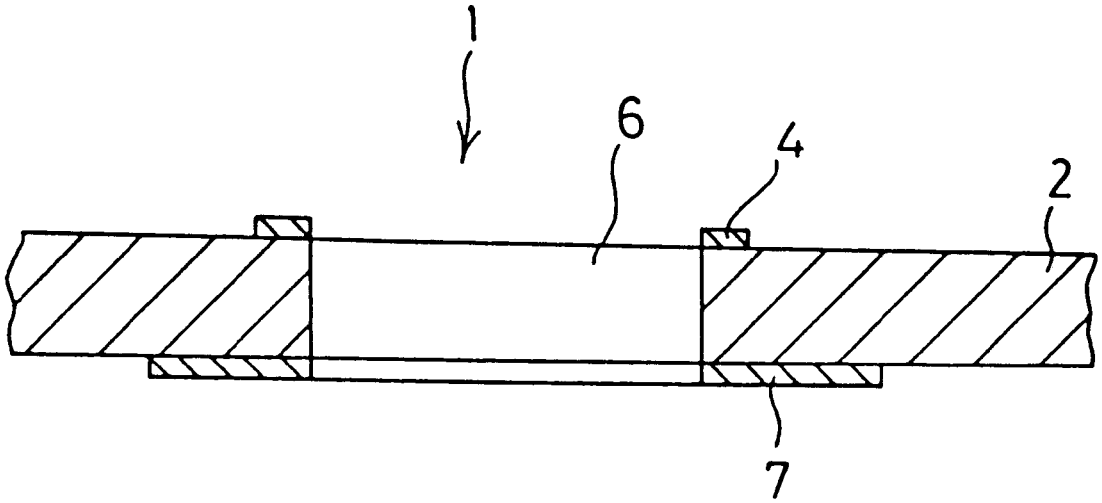
FIG. 4 is a partial cross-sectional view of the aperture electrode member of another embodiment.

For example, while the control voltage of 0 volt is applied to the apertures 6, which correspond to the non-image portion in the above-mentioned embodiment, a negative voltage can be applied. If a negative voltage is applied, an image with very little fogging can be obtained. Also, while the aperture electrode member is used as the electric field control means in the above-embodiment, a mesh electrode member as disclosed in U.S. Pat. No. 5,036,341 can be used. Further, while the protection layer 7 is formed on the whole surface of the aperture electrode member in the above-embodiment, the layer 7 can be arranged around the apertures 6 as shown in FIG. 4.

What is claimed is:

1. An image forming apparatus comprising:

a toner supply that supports and supplies charged toner particles;

a toner flow control member having openings therein and control electrodes formed around said openings, said toner flow control member and said toner supply sandwiching the charged toner particles therebetween, and said toner control member controlling a flow of the charged toner particles through said openings with an electric field, said toner flow control member being generally non-planar and in sliding contact with said toner supply, wherein an insulative inorganic substance is provided on at least a surface of said toner flow control member facing said toner supply, said insulative substrate avoiding wear on said toner flow control member created by said sliding contact of said toner supply and said toner flow control member, and a back electrode confronting said toner flow control member and attracting charged toner particles that have passed through said openings, wherein said back electrode and said toner flow control member are positioned to sandwich an image receiving medium therebetween.

2. The image forming apparatus of claim 1, wherein said insulative inorganic substance is non-charging.

3. The image forming apparatus of claim 1, wherein said insulative inorganic substance is selected from the group consisting of alumina, zirconia, nitriding silicon, carbonization silicon, oxidation silicon, oxidation chrome, oxidation tantalum, nitriding tantalum, titanium oxide and glass.

4. The image forming apparatus of claim 1 wherein said insulative inorganic substance is a thin film disposed on a surface of said toner flow control member at least surrounding said control electrodes.

5. The image forming apparatus of claim 1 wherein said insulative inorganic substance is a thin film disposed on substantially an entire surface of said toner flow control member facing said toner supply.

6. The image forming apparatus of claim 1 wherein said toner supply comprises a toner particle casing that stores toner particles, a toner carrier member adjacent to said toner particle casing that receives toner particles from said toner particle casing and transports toner particles to said toner flow control member and a toner trimming blade disposed adjacent to said toner carrier member that adjusts a layer of toner particles carried by said toner carrier member.

7. The image forming apparatus of claim 1 further comprising a voltage supply coupled to said control electrodes to selectively supply a voltage to said control electrodes, and a power supply coupled to said back electrode to supply a voltage to said back electrode.

8. An image forming apparatus comprising:

toner supply means for supporting and supplying charged toner particles;

toner flow control means for controlling a flow of charged toner particles from said toner supply means with an electric field, said toner flow control means comprising an insulative sheet with openings therein, a control electrode surrounding each opening, and an insulative inorganic layer provided on a surface of said toner flow control means facing said toner supply means, wherein charged toner particles are sandwiched between said insulative inorganic layer of said toner flow control means and said toner supply means and flow through said openings due to the electric field, said toner flow control means being generally non-planar and in sliding contact with said toner supply means, wherein said insulative inorganic layer avoids wear on said toner flow control means created by said sliding contact of said toner supply means and said toner flow control means; and a back electrode means for attracting charged toner particles that have passed through said openings and for supporting an image receiving medium adjacent to said toner flow control means that receives charged toner particles to form an image thereon.

9. The image forming apparatus of claim 8, wherein said insulative inorganic layer has a non-charging property.

10. The image forming apparatus of claim 8, wherein said insulative inorganic layer is made of a material selected from the group consisting of alumina, zirconia, nitriding silicon, carbonization silicon, oxidation silicon, oxidation chrome, oxidation tantalum, nitriding tantalum, titanium oxide and glass.

11. The image forming apparatus of claim 8 wherein said insulative inorganic layer is a thin film disposed on a surface of said toner flow control means at least surrounding said control electrodes.

12. The image forming apparatus of claim 8 wherein said insulative inorganic layer is a thin film disposed on substantially an entire surface of said toner flow control means facing said toner supply means.

13. The image forming apparatus of claim 8 wherein said toner supply means comprises a toner particle casing for storing toner particles, a toner carrier member adjacent to said toner particle casing that receives and transports toner particles to said toner flow control means and a toner trimming blade disposed adjacent to said toner carrier member that adjusts a layer of toner particles carried by said toner carrier member.

14. The image forming apparatus of claim 8 further comprising a voltage supply means coupled to said control electrodes for selectively supplying a voltage to said control electrodes, and a power supply means coupled to said back electrode means for supplying a voltage to said back electrode means.

15. An image forming apparatus comprising:

a toner supply that supplies charged toner particles, including a toner carrier member that carries said charged toner particles;

an image support that supports an image formed of charged toner particles based on image data; and a toner flow control member disposed between said toner supply and said image support, said toner flow control member being generally non-planar and directly contacting said toner carrier member that carries said charged toner particles, said direct contact being on one surface of said flow control member, said toner flow control member including a plurality of apertures surrounded by control electrodes that create an electric field to selectively draw charged toner particles through said apertures and including a protection layer disposed on said surface directly contacting said toner carrier member made of inorganic non-charging material.

16. The image forming apparatus of claim 15 wherein said protection layer is made of material selected from the group consisting of alumina, zirconia, nitriding silicon, carbonization silicon, oxidation silicon, oxidation chrome, oxidation tantalum, nitriding tantalum, titanium oxide and glass.

17. The image forming apparatus of claim 15 wherein said toner flow control member is a polyimide insulative sheet.

18. The image forming apparatus of claim 15 wherein said protection layer is a thin film and is formed by a thin film formation method.

19. The image forming apparatus of claim 15 wherein said protection layer is a thin film formed on substantially an entire surface of said toner flow control member.

20. The image forming apparatus of claim 15 wherein said protection layer is a thin film formed only around said apertures on said surface of said toner flow control member.

21. The image forming apparatus of claim 1, wherein said toner supply being positioned beneath said toner flow control member.

22. The image forming apparatus of claim 8, wherein said toner supply means being positioned beneath said toner flow control means.

* * * * *